United States Patent [19]

Köbler

[11] Patent Number: 4,601,387

[45] Date of Patent: Jul. 22, 1986

[54] TRANSPORT PATH FOR PAPER PRODUCTS WITH SPEED REDUCTION, PARTICULARLY FOR PRINTING MACHINERY IN COMBINATION WITH FOLDING APPARATUS

[75] Inventor: Ingo Köbler, Anhausen, Fed. Rep. of Germany

[73] Assignee: M.A.N. ROLAND Druckmaschinen Aktiengesellschaft, Offenbach am Main, Fed. Rep. of Germany

[21] Appl. No.: 649,900

[22] Filed: Sep. 12, 1984

[30] Foreign Application Priority Data

Sep. 12, 1983 [DE] Fed. Rep. of Germany ..... 3332809
Oct. 26, 1983 [DE] Fed. Rep. of Germany ..... 3338814

[51] Int. Cl.[4] ..... B65G 15/14

[52] U.S. Cl. ..... 198/626; 74/393; 271/270; 198/858

[58] Field of Search ..... 198/626, 858, 859; 271/202, 203, 270; 74/393; 474/141

[56] References Cited

U.S. PATENT DOCUMENTS 3,152,595 10/1964 Silberman ..... 198/626 X
3,601,241 8/1971 Kuhnt et al. ..... 198/858 X

FOREIGN PATENT DOCUMENTS 905138 2/1954 Fed. Rep. of Germany .
1561722 4/1970 Fed. Rep. of Germany .
3049595 7/1982 Fed. Rep. of Germany .
3321811 12/1984 Fed. Rep. of Germany .
561067 5/1944 United Kingdom ..... 74/393
2008079 5/1979 United Kingdom .

*Primary Examiner*—Joseph E. Valenza
*Assistant Examiner*—Jonathan D. Holmes
*Attorney, Agent, or Firm*—Frishauf, Holtz, Goodman & Woodward

[57] ABSTRACT

To provide a belt transport path in which the belts cyclically decelerate and accelerate, to feed paper subject matter, for example from a "first longitudinal folding apparatus" to a "second longitudinal folding apparatus" at reduced speed, two eccenter pulleys are located in respectively different planes, for example parallel to each other, rotating on a common shaft, and having the same eccentricity (x). A first run of the belt is guided from the paper transport path to loop, in part, about a first eccenter pulley, then guiding a second run of the belt from the first eccenter pulley into the plane of the second eccenter pulley, and a second guide pulley guides a third run of the belt from the second eccenter pulley back to the transport path. Two belt system may be used, located in mirror-image relationship, or a single belt can be guided adjacent the run which contacts the transported subject matter (E) from an eccenter located outside the plane of the printed subject matter. The eccenters may be circular pulleys, or may be elliptical, to provide for sinusoidal speed variation of the belt within the transport path.

15 Claims, 11 Drawing Figures

Fig.3
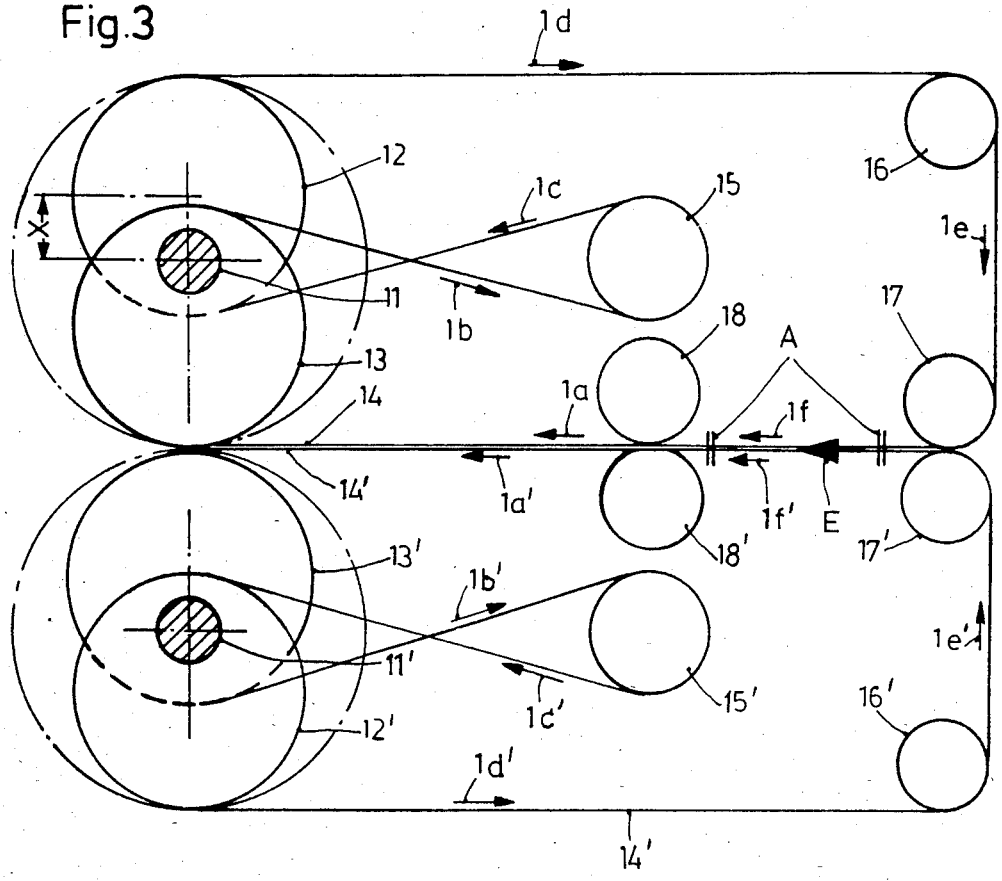
Fig.4
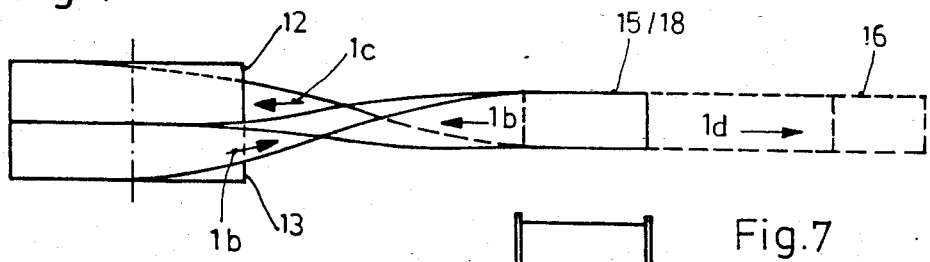
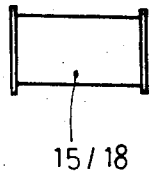
Fig.7

TRANSPORT PATH FOR PAPER PRODUCTS WITH SPEED REDUCTION, PARTICULARLY FOR PRINTING MACHINERY IN COMBINATION WITH FOLDING APPARATUS

Reference to related application, assigned to the assignee of the present application:

U.S. Ser. No. 616,176, filed June 1, 1984 now U.S. Pat. No. 4,516,759, issued May 14, 1985, by the inventor hereof.

The present invention relates to a transport mechanism, particularly to transport already folded printed subject matter to a further folding apparatus which operates at a speed which is less than the speed with which the printed products are being supplied thereto, and more particularly to a transport path which provides for delerating the printed subject matter so that it will be supplied to the utilization apparatus at a suitable speed which it is capable of handling.

BACKGROUND

Speed delay apparatus of the type to which the present invention relates usually include transport belts on which printed sheets, assemblies of sheets and the like, for example already prefolded newspapers, are driven at a speed which varies in cycles, so that, when the printed subject matter is received, the speed of the belts will be the same as the supply speed of the elements. During the travel along the transport path, the belts decelerate, thereby decelerating the printed subject matter as well so that, when the printed subject matter is delivered to a utilization apparatus, such as a second folding apparatus, it will be supplied thereto at a speed which is less than the receiving speed, and one which the utilization apparatus is capable of accomodating.

In my prior patent application U.S. Ser. No. 616,176, filed June 1, 1984, there is described a folding apparatus which is separated by belt sections which form a retardation line or retardation path. The change in speed of the belt section is obtained by rhythmically shifting deflection rollers in the rhythm of the cyclical deceleration, and subsequent acceleration, of the belt.

The shifting back-and-forth of the deflection rollers entails friction in guide rails and, further, the transport belts are subjected to additional wear.

THE INVENTION

It is an object to improve a paper transport system which includes a retardation or delaying feature in which rhythmic or cyclical web or belt acceleration and deceleration is controlled while placing no or only very little additional stress, and hence wear, on the belts or webs forming the transport path or transport system.

Briefly, the cyclical acceleration and deceleration is obtained solely by rotation of tape guide elements which are, however, eccentrically mounted in such a way that the path of the belts or webs which includes the transport is rhythmically elongated and foreshortened, thereby increasing and decreasing the relative speed of the web within the transport path.

In accordance with a feature of the invention, first and second eccenter pulleys are provided, located in respectively different planes, preferably parallel and adjacent each other. A run of the belt is guided to loop, in part, about a first eccenter pulley; a second run of the belt is guided from the first eccenter pulley in the plane of the second eccenter pulley; and a second guide pulley is provided to guide a third run of the belt from the second eccenter pulley back to the transport path. The eccenter pulleys are located on a common shaft and have the same degree of eccentricity. They are, preferably, of equal size.

DRAWINGS

FIG. 3 is a second embodiment of the system in side view;

FIG. 4 is a top view of the system of FIG. 3;

FIG. 7 is a side view of a belt guide roller;

Figures 8, 8A:
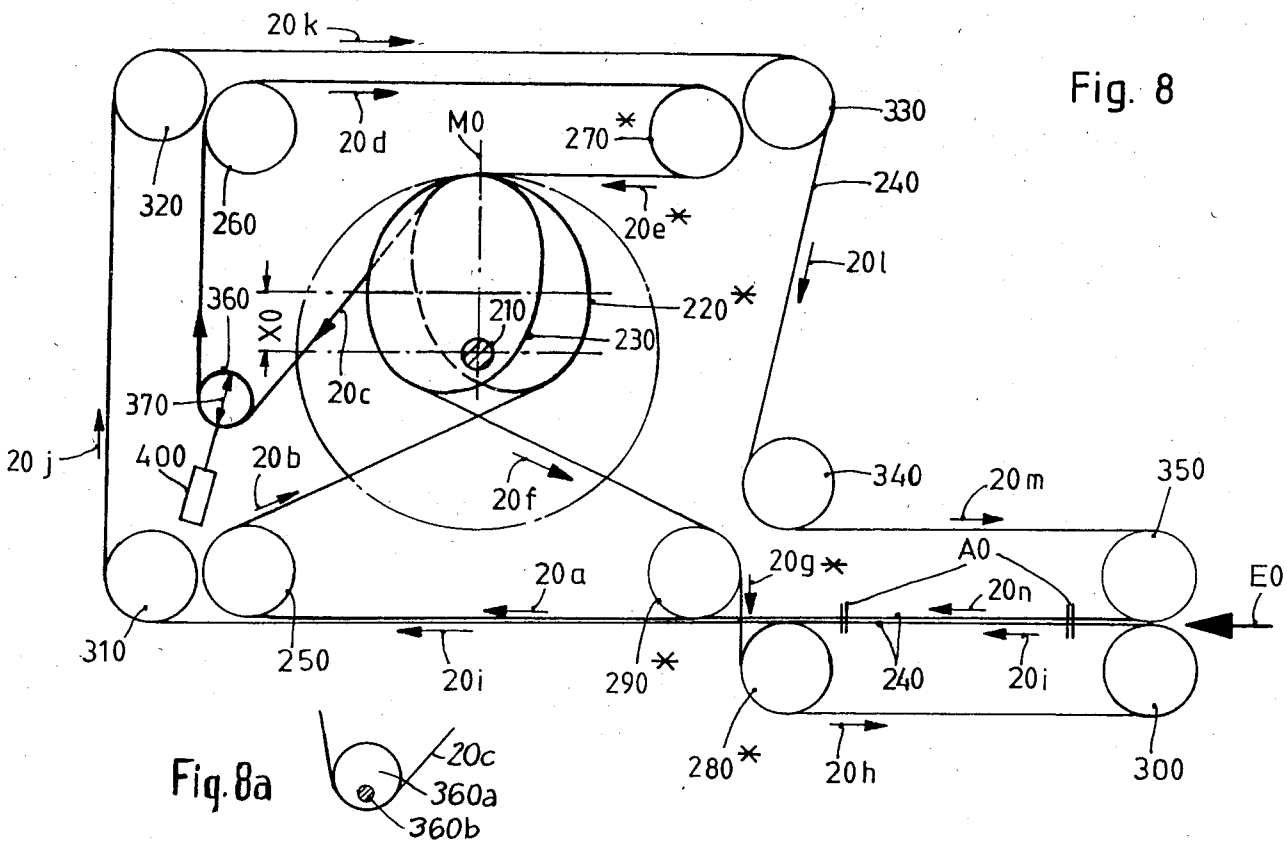
FIG. 8 is another embodiment of a deceleration system in side view.
Figure 9:
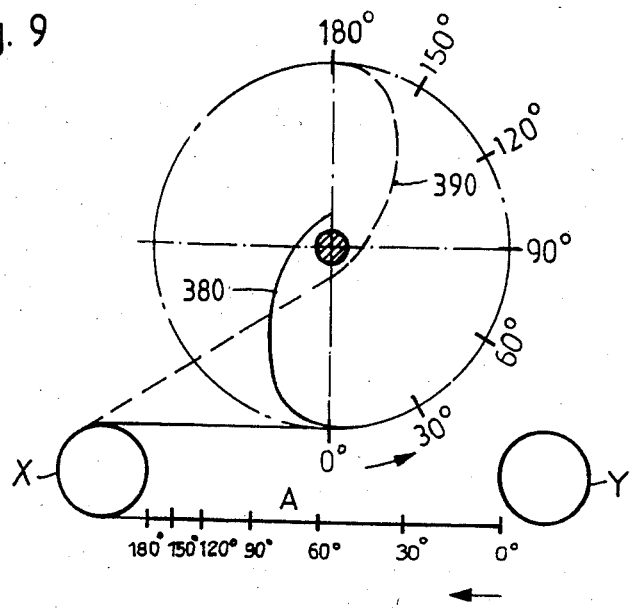
Figure 10:
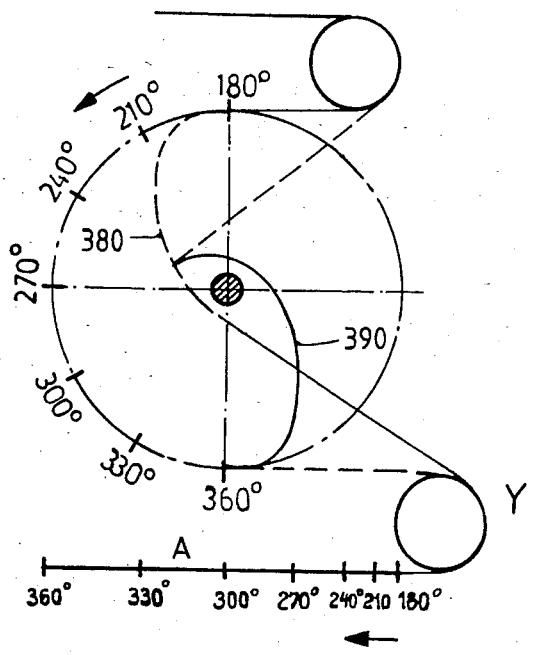

FIG. 8*a* is a fragmentary belt run representation illustrating another embodiment with an eccenter as a path length compensation element;

and FIGS. 9 and 10 are developed graphs illustrating empirical possibilities of developing eccenter curves to obtain sinusoidal acceleration and deceleration with the system of FIG. 7.

In the description to follow, and where applicable, the components of systems which are arranged in mirror image have been given the same reference numerals with prime notation.

DETAILED DESCRIPTION

The deceleration or delay transport path can be located, for example, downstream of a folding cylinder or collection cylinder of a folding apparatus in order to provide for printed subject matter a third fold, which is termed in the industry "second longitudinal fold". As well known, such apparatus which provides a "third fold" or "second longitudinal fold" requires supply of printed subject matter at a lower speed than that with which it is supplied from a printing machine or from the cylinders thereof. It is thus necessary that the printed subject matter be retarded or decelerated. The belt deceleration path, thus, must receive the folded printed subject matter at machine speed, decelerate the subject matter, and supply it to the "second longitudinal fold" folding apparatus, for example a pair of folding rollers, at a decelerated and decreased speed which is less than the speed at which the subject matter was received.

Figure 1:
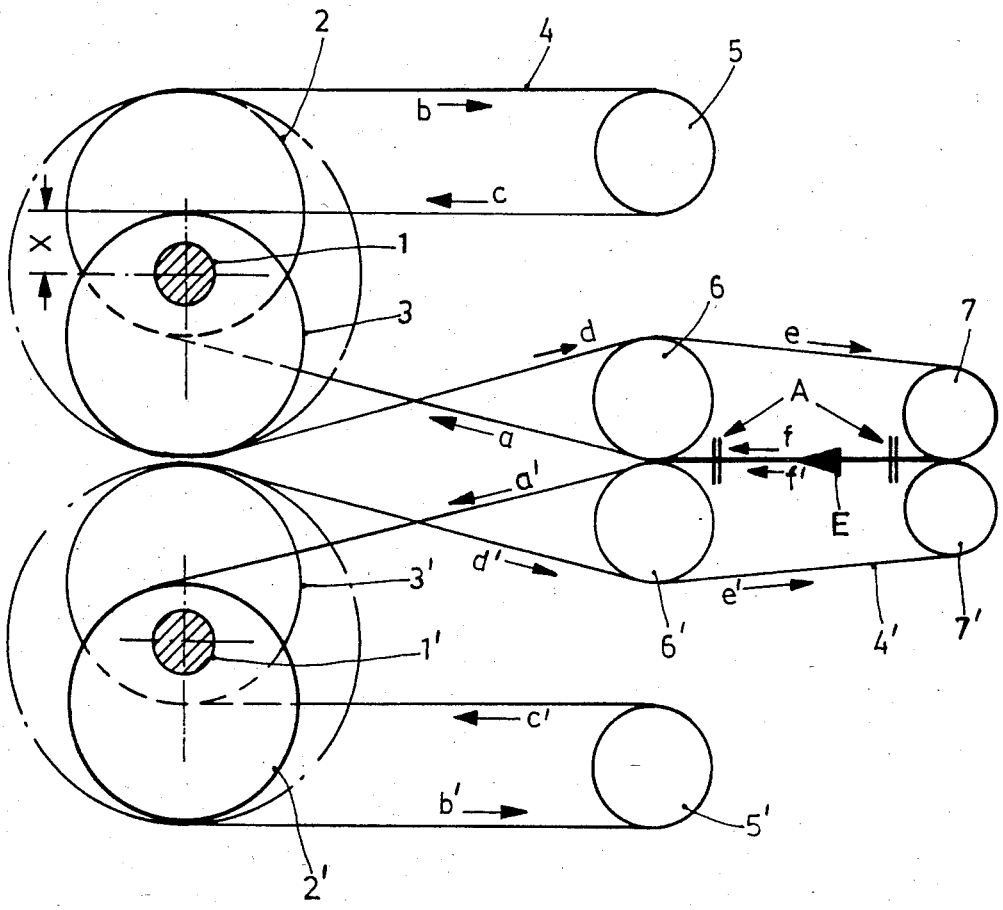
FIG. 1 is a schematic side view of a first embodiment of a belt transport system.
Figure 2:
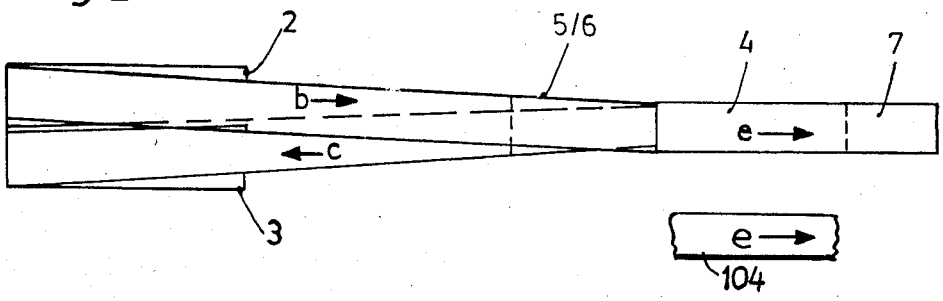
FIG. 2 is a top view of the system of FIG. 1.

Embodiment of FIGS. 1 and 2: Printed subject matter schematically shown at E, and received at the right side—with reference to FIG. 1—is supplied to the delay or retardation path A of the tranport path in which the printed subject matter E travels. The belt delay system, essentially, includes two eccentric pulleys or, in short eccenters 2, 3, located on a common shaft 1 and rotating therewith. The upper belt 4 is guided or looped in part over the eccenters. As best seen in FIG 1, the two eccenters 2, 3 have the same eccentricity x. The eccenters 2 and 3 are identical in size and shape. The eccenter 3 is offset on the shaft 1 by 180° with respect to the eccenter 2.

The portion of the belt or run a is guided to the upper eccenter 2 beyond or downstream or behind the retardation path A. As seen in FIG. 2, the two eccenters are located adjacent each other in parallel planes, the eccenter 2 being positioned in a plane different from that of the eccenter 3. After partially looping about the eccenter 2, the portion or run b leaves the eccenter 2 and is guided about a deflection guide roller 5. The deflection roller 5 is provided to deflect the belt 4 and, additionally, guide the belt from the plane of the eccenter 2 into the plane of rotation of the eccenter 3—see FIG. 2. The run c of the belt then guides it to the eccenter 3, the belt loops in part thereabout, and the subsequent run d is then guided over a guide roller 6, and then run e is guided about guide roller 7, to be returned to the delay paper guide path A. The run f forms the actual delay portion, which is positioned between the rollers 6 and 7. Return of the run a into the plane of the eccenter 3 is also controlled by the guide roller 6.

The system shown in FIGS. 1 and 2 has two belts, namely an upper and a lower belt. The lower belt 4' is guided similarly to belt 4, and the arrangement is a mirror image of that just described, and similar elements have been given the same reference numerals with a prime notation, and therefore need not be explained again.

Operation: By guiding the belts 4, 4' as shown, and so arranging the eccenters that they rotate with the common shaft 1, 1', respectively—which are preferably driven—the belts 4, 4' will change their speed in the rhythm or cadence or the rotation of the eccenters 2, 3, and 2', 3', respectively. Printed subject matter E received from the right at maximum speed is gripped and transported while being decelerated. When the subject matter E has reached minimum speed, they can be folded, for example by a folding knife or other folding apparatus—not shown in the drawing for simplicity, and which can be of any well known and suitable construction.

By so arranging the eccenters 2, 3, and 2', 3', respectively, a cyclical variation in speed is obtained which results effectively in a path compensation for the belts 4, 4' without requiring longitudinally shiftable deflection apparatus. The arrangement is inexpensive and can be made simply and with minimum material and cost requirements.

Embodiment of FIGS. 3 and 4: The elements used in the embodiment of FIGS. 3 and 4 are quite similar to those used in the embodiment of FIGS. 1 and 2, and those which are essentially identical have been given the same reference numerals, with a 1 ahead of the reference numeral.

Upper belts 14 and lower belts 14' are guided about eccenters 12, 13 and 12', 13', respectively, which are secured on respective shafts 11, 11' to rotate therewith. The belts 14, 14' are guided and directed in the respective planes of the eccenters 12, 13, and 12', 13', respectively, by guide and deflection rollers 15, 15' and 18, 18'.

Operation: The belt 14 is guided with its run 1*a* about eccenter 13 and then with run b about deflection roller 15 which, with run 1*c*, guides the belt about eccenter 12. As best seen in FIG. 4, the belts are twisted by 180° in front of as well as behind the deflection roller 15, that is, the runs 1*b* and 1*c*, each, are twisted by 180°, the twists, of course, being in opposite direction. This means that the run 1*b* is twisted, for example, by 180° towards the right; the run 1*c*, then, will be twisted by 180° towards the left, that is, twisted back. The double twist provides for a desirable and preferred guidance of the belt runs between the eccenters 11, 12 and the deflection roller 15.

The run 1*d* behind eccenter 12 is returned over deflection roller 16 to the guide roller 17 which guides the belt into the deceleration path A. The deceleration path A is positioned between the guide rollers 17, 18, the guide roller 18, which is preferably positioned beneath the deflection roller 15 guiding the run 1*a* into the plane of the eccenter 13.

Comparing the embodiment of FIGS. 1 and 2 with the embodiment of FIGS. 3 and 4 will shown that the embodiment of FIGS. 3 and 4 is somewhat more space-consuming, since the belt 14 with its runs 1*d*, 1*e* must be guided at the outside about the guide roller 16.

The belt is guided about pulley 7, however, only over one-quarter of its circumference, rather than approximately half-way around, as in FIG. 1, and does not contact the downstream guide roller of the delay line, in FIG. 3 roller 18, and in FIG. 1 roller 6.

Figure 5:
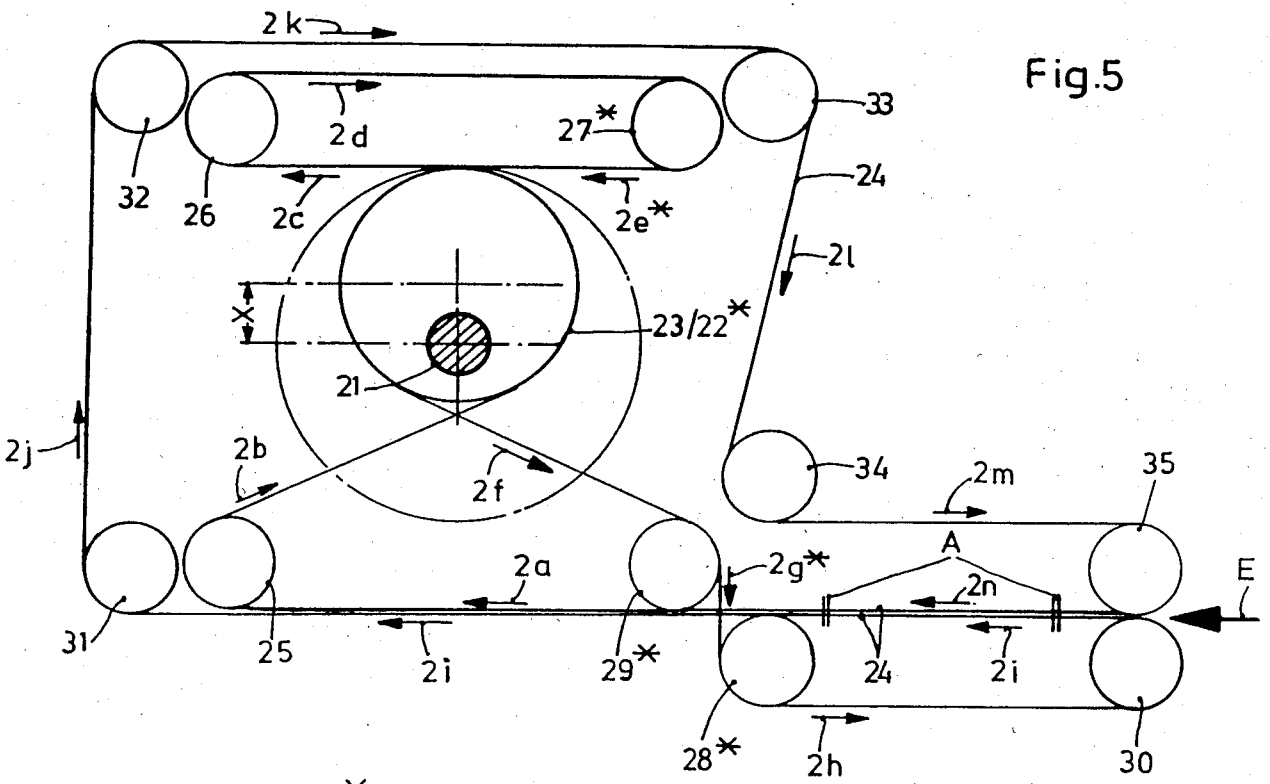
FIG. 5 is a schematic side view of a belt delay transport path with only one belt system.
Figure 6:
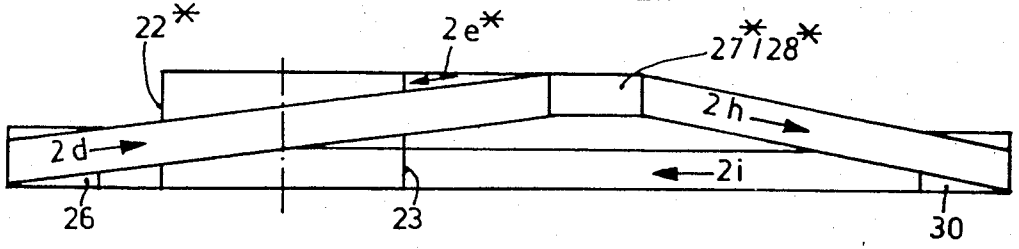
FIG. 6 is a top view of the path of FIG. 5.

Embodiment of FIGS. 5 and 6: In this system, rather than using two belt systems which are the mirror image of each other, only a single belt is used. The eccenter is somewhat differently arranged in that the eccenters 22, 23 are not offset with respect to each other by 180° but, rather, are essentially congruent.

Similar elements and similar runs as previously described have been given the same reference numeral with a 2 or 3, respectively, placed in the "10" position.

Belt path: Printed subject matter E is again received at the right side (FIG. 5) to be introduced into the deceleration transport path A, at maximum speed, to be decelerated as previously described. The run 2*a* is guided about a guide roller 25 which is in the forward plane of the system, that is, in the plane of the forward or front eccenter 23 (see FIG. 6). The run 2*b* is then fed to the forward eccenter 23 after having been looped over roller 25.

The belt run 2*c* is then guided to a guide roller 26, positioned, likewise, in the plane of the eccenter 23. The offset to the plane of the eccenter 22 occurs in the run 2*d* to the guide roller 27. The run 2*e*, after looping about the guide roller, is guided to the rear eccenter 22. "Forward" and "rear" have been selected for convenience of explanation with reference to FIGS. 5 and 6, and, of course, the position can be reversed. After partial looping about the eccenter 22, the run 2*f* is guided over roller 29 which is located in the plane of the eccenter 22, and then to guide roller 28, in the same plane as the run 2*g*. To better distinguish the position of the respective guide rollers in the respective planes, those rollers or elements which are located in the rear plane have been given an asterik (*) notation in the drawing. The belt 24 is then returned in the run 2*h* into alignment with the upper portion of the belt by the roller 30 which is located in the plane of the eccenter 23, that is, in the forward plane.

Operation: As best seen in FIG. 5, the lower belt run 2*i* of the delay path is formed between the belt rollers 30, 31. The upper belt portion 2*n* of the delay or retardation path A is formed by a return run, that is, by a return guidance about the entire system. This is accomplished by guiding the run 2*j*, subsequent to the run 2*i*, about roller 31, then roller 32, run 2*k* about the guide roller 33, followed by run 21 about the guide roller 34 which then forms run 2*m* about the guide roller 35. The upper run of the retardation path A is formed by runs 2*n* and 2*i* between the rollers 35, 25 and 30, 31, respectively. All the guide rollers 30, 31, 32, 33, 34, 35 are in the same plane, namely the forward plane.

As described, rotation of the eccenters 22, 23 about the shaft 21 provides a cyclical delay and acceleration of the belt portions or runs 2*i* and 2*n* within the delay path A, thereby automatically affecting the required path compensation due to the double eccenters 22, 23.

The width of the belt can be in accordance with any well known and suitable dimension; of course, more than one belt system may be located positioned transversely to the transport direction, so that two or more belts 4, 104, shown only in FIG. 2, can run adjacent each other in the same plane. Guiding the printed elements E on and between two spaced belts insures reliable seizing of the printed subject matter E, and transporting and delaying their speed to the utilization apparatus, such as a folding apparatus (not shown).

A deflection roller 15, 18, suitable in the system, is shown in FIG. 7; as illustrated, it is formed with end flanges on both sides to provide for reliable guidance of belts used in the belt transport system for printed subject matter.

The term "eccenter" as used herein is not necessarily restricted to eccentrically located circular pulleys, rollers or sheaves or wheels; it also includes elements which have cam or eccenter-like curves. The two eccenters which are used do not necessarily require identical curves, but they can be so calulated or so arranged that no relative movement will occur. FIGS. 8 to 10 illustrate such arrangements.

Embodiment of FIG. 8: Printed subject matter EO is received in the belts at high speed; after seizing the subject matter, the belts decelerate to supply the printed subject matter to a utilization apparatus (not shown) at lower speed.

Belt path of FIG. 8: Printed subject matter EO received from the right of the deceleration path AO is delayed, after reception at maximum speed, so that, for example, the printed subject matter can be folded in a folding apparatus operating in downward direction.

The belt run 20*a* is guided to a guide roller 250, located in the plane of a forward eccenter of a cam curve disk or pulley 230. The run 20*b* from the guide roller 250 then supplies the tape to the front or forward eccenter 230. After being looped in part about the eccenter 230, the run 20*c* is looped about a guide roller 260 which is likewise located in the plane of the eccenter 230. The shift to the plane of the rear eccenter 220—again indicated to be in the rear plane by an asterisk (*) in FIG. 8—occurs in the run 20*d*. Roller 270 is in the rear plane. The run 20*e* then is looped directly over the rear eccenter 220. After partial looping about the eccenter 220, the run 20*f* of the belt 240 leads to the roller 290 which is likewise in the plane of the eccenter 220. The belt then passes beneath the delay section, in run 20*g*, and is supplied to the guide roller 280, where run 20*h* extends to guide roller 300 which, again, will be in the forward plane.

Operation: The lower run 20*i* of the delay section AO is formed between the rollers 300 and 310. The upper belt portion of the delay section is formed by run 20*n*, and is effected by a return guidance of the belt over the entire system. Thus, section 20*j*, received from guide roller 310, is guided about roller 320, followed by run 20*k*, guided about roller 330, formed as run 201 about guide roller 340, and as run 20*m* to guide roller 350. The upper run 20*n* of the delay section AO is then formed between the guide rollers 350 and 250. All the guide rollers 300 to 330 are in the same plane. Upon rotation of the eccenters 220, 230 about shaft 210, the belt runs 20*i* and 20*n* will, cyclically, retard and accelerate, thus causing retardation and acceleration within the delay or retardation path AO. Of course, more than two belts can be located in planes immediately adjacent each other in order to reliably guide and transport printed subject matter EO.

In contrast to the arrangement of FIGS. 1–7, the belt run 20*c* from the forward eccenter 230 does not extend immediately to the guide roller 260 but about a roller 360 which forms a band or belt length compensation element. The roller 360 is movable, as shown by the arrow 370, up and down, for example by a cylinder-piston element 400, so that, due to the external contour of the eccenters 220, 230, compensation for the rhythmically occurring differences in effective belt length can be achieved.

Rather than using a piston which carries a roller 360, rotating about its center axis, an eccenter can be used which has an outer contour and an eccentricity which is so determined that the differences in effective belt path length can be compensated. FIG. 8 illustrates such an arrangement, in which a guide roller 360*a* is eccentrically mounted and rotatable about a shaft 360*b*. Shaft 360*b* may be driven in order to maintain belt tension.

The two eccenters 220, 230 are located mirror-image symmetrically with respect to a common center line MO—see FIG. 8. In order to obtain minimum differences in effective belt length, the contour of the eccenters deviates from circular. One-half of the outer contour, in the example illustrated in FIG. 8, has the form of an isometric ellipe; the other half has the form of a dimetric ellipse. Consequently, the delay and acceleration in the portions 20*i* and 20*n* of the delay path AO will be sinusoidal in the delay path A8 upon rotation of the eccenters 220, 230. The degree of eccentricity XO of the eccenters 220, 230 depends on the relation of maximum speed to minimum speed. Theoretically, a minimum speed of zero can be obtained when the eccentricity corresponds to half the diameter, that is, when both eccenters 220, 230 rotate about a point which is on their periphery. In actual practice, a relationship of about 4:1 is sufficient; for such retardation, the common center of rotation should be placed approximately at the level of the lower focal point of the two eccenters 220, 230, and the eccenters should be given the shape of an at least approximately elliptical curve.

FIGS. 9 and 10 show developed curves of an eccenter, the contour of which had been empirically determined, in order to obtain the desired sinousoidal delay or retardation and acceleration of the belts within the path section AO.

FIG. 9 illustrates the region of between 0° to 180° of the development of the outer contour 380 in steps of 30° of one-half of an eccenter in accordance with the present invention, which rotates from between 0° to 180° in the direction of the arrow.

The outer contour 390, shown in broken lines, as yet does not have any influence. The path length in the delay section A between two guide rollers X and Y is entered for each of 30° steps. FIG. 9 clearly shows that in the range of from 0° to 180°, the belt portion moving from the right towards the left within the delay path A retards in accordance with a sinusoidal function.

FIG. 10 illustrates the development of a sinusoidal acceleration, by means of the curve 390 between 180° and 180° in the delay line A. As in FIG. 9, the linear movement of the belt is again shown for angles or rotation of 30° in the delay path A.

In FIG. 9, the curve 380, that is, the left half of the eccenter, and in FIG. 10 the curve 390, that is, the right half of the contour, are the only portions which are responsible for deceleration and acceleration, respectively, and thus only those regions have been drawn in full lines. Those portions not immediately causing acceleration or deceleration of the belt, respectively, are shown only in broken lines in the drawings of FIGS. 9 and 10.

Due to the mirror image arrangement of the eccenters 220, 230 about the common center line MO, a mimimum path length in the section 20*c* needs to be compensated, so that the stroke of the compensating element 400 need not be long; or the eccentricity of an eccenter 360*a* need not be very large, or the circumference of the eccenter wheel can be held small.

Various changes and modifications may be made, and features described in connection with any one of the embodiments may be used with any one of the others, within the scope of the inventive concept.

The drawings FIGS. 1, 3, 5, 8 illustrate, additionally, the outer circle path in chain-dotted representation, merely to illustrate the swing of the eccenters as they rotate.

I claim:

1. Paper handling apparatus to reduce the speed of transport of paper elements (E) in a tranport path (A) having an endless transport belt means (4, 14, 24, 104, 240) located to grip the paper and transport the paper from a receiving position to a utilization position, while decelerating the paper during transport thereof in the transport path, comprising, in accordance with the invention, eccenter pulley means including first and second eccenter pulleys (2, 13, 23, 220; 3, 12, 22, 230) located in respective different planes;

a common shaft (1, 11, 21) connected to rotate with said first and second eccenter pulleys, said first and second eccenter pulleys having the same eccentricity (x) with respect to their common shaft;

said belt means being guided in a first run (a, 1*a*, 2*a*, 20*a*) from the transport path to loop, in part, about a first eccenter pulley (2, 13, 23, 220);

first guide pulley means (5, 15, 27, 270) guiding a second run (c, 1*c*, 2*c*, 20*c*) of the belt means (4, 14, 24, 104, 240) from said first eccenter pulley (2, 13, 23, 220) into the plane of the second eccenter pulley (3, 12, 22; 230);

and second guide pulley means (6, 18, 30, 300) guiding a third run of the belt means (4, 14, 104, 24, 240) from said second second eccenter pulley back to the plane of the transport path.

2. Apparatus according to claim 1, wherein said eccenter pulleys are located in two parallel planes positioned adjacent each other and secured to the common shaft, and have essentially the same size and shape.

3. Apparatus according to claim 1, including belt guide rollers (6, 7; 17, 18; 25, 35; 250, 350) located at the terminal ends of the transport path, and positioned in a common plane.

4. Apparatus according to claim 1, wherein the belt is guided in a twisting path, including a first twist of 180° in a first direction, and a reverse twist of 180° in a second direction in the run of the belt between the first eccenter pulley (13) and said first guide pulley means (15) and the run of the belt between the second eccenter pulley (12) and the first guide pulley means (15).

5. Apparatus according to claim 1, wherein the eccenters are circular pulleys having their eccentricity 180° offset with respect to each other in relation to said common shaft (1, 11).

6. Apparatus according to claim 1, wherein said belt means, said eccenter pulley means, and said guide pulley means include two transport belts, two first and second eccenter pulleys, and two first and second guide pulley means respectively, located in opposed mirror-image relationship with respect to each other such that the respective belts (4, 14; 4', 14') operate adjacent each other to grip a paper element (E) therebetween.

7. Apparatus according to claim 1, wherein the first and second eccenter pulleys are circular, and located on said common shaft (21) to be congruent with respect to each other.

8. Apparatus according to claim 7, wherein a single belt (24, 240) is provided, said belt being guided in a first transport run (2*i*, 20*i*) and a second transport run (2*n*, 20*n*) adjacent each other and positioned to grip the paper elements (E) between said first and second transport run;

wherein said second transport run (2*n*, 20*n*) is formed by guiding a portion of the belt (24, 240) about the eccenter pulleys and said first and second guide pulley means laterally of said first transport run;

and wherein additional guide pulleys (31, 32, 33, 34, 35; 310, 320, 330, 340, 350) are provided guiding said first run in a first plane and further guide pulleys (29, 28; 290, 280) guide said belt laterally of the first run;

and a return pulley (30, 300) is provided returning the portion of the belt laterally of said first transport run to the plane of said first transport run.

9. Apparatus according to claim 1, wherein a single belt (24, 240) is provided, said belt being guided in a first transport run (2*i*, 20*i*) and a second transport run (2*n*, 20*n*) adjacent each other and positioned to grip the paper elements (E) between said first and second transport run;

wherein said second transport run (2*n*, 20*n*) is formed by guiding a portion of the belt(24, 240) about the eccenter pulleys and said first and second guide pulley means laterally of said first transport run;

and wherein additional guide pulleys (31, 32, 33, 34, 35; 310, 320, 330, 340, 350) are provided guiding said first run in a first plane and further guide pulleys (29, 28; 290, 280) guide said belt laterally of the first run;

and a return pulley (30, 300) is provided returning the portion of the belt laterally of said first transport run to the plane of said first transport run.

10. Apparatus according to claim 1, wherein a plurality of transport belts (4, 104) are provided, located laterally adjacent each other with respect to the direction of the paths of the belts and operating in parallel.

11. Apparatus according to claim 1, wherein the eccenter pulleys comprise eccenter curve disks;

and wherein said eccenter curve disks have a curve shape which differs from circular and defines an outer contour or curve which, in the transport path (AO) causes rhythmic deceleration and acceleration of the transport belt (240) in sinusoidal rhythm;

and wherein a belt length compensating element (360, 400; 360*a*, 360*b*) is provided, positioned in the second run (20*c*) of the belt in which the belt (240) is guided from the plane of one of said eccenter pulleys (220) into the plane of the other eccenter pulley (230).

12. Apparatus according to claim 11, wherein the belt length compensating element comprises a roller (360) rotating about its center;

and a piston-cylinder arrangement (400) positioning said roller in accordance with the length of the belt between the eccenter disks.

13. Apparatus according to claim 11, wherein the belt length compensating element comprises a rotating curve or cam disk (360*a*).

14. Apparatus according to claim 11, wherein said eccenter pulleys (230, 220) are located in mirror-image position, with respect to a common center line (MO) on the common shaft (210).

15. Apparatus according to claim 11, wherein one-half of the eccenter pulley has a circumferential shape which is approximately an isometric ellipse, and another half which has approximately the shape of a dimetric ellipse;

and wherein said eccenter pulleys have a common center of rotation about said shaft (210) which is located at least approximately at the level of one of the focal points of the ellipse.

* * * * *

UNITED STATES PATENT AND TRADEMARK OFFICE

CERTIFICATE OF CORRECTION

PATENT NO. : 4,601,387

DATED : July 22, 1986

INVENTOR(S) : Ingo KOBLER

It is certified that error appears in the above-identified patent and that said Letters Patent is hereby corrected as shown below:

Col. 7, claim 1, line 48 should read -- from said second eccenter pulley back to --

Signed and Sealed this

Twenty-third Day of December, 1986

*Attest:*

DONALD J. QUIGG

*Attesting Officer* *Commissioner of Patents and Trademarks*